US012805613B2

(12) United States Patent
Yamauchi et al.

(10) Patent No.: US 12,805,613 B2
(45) Date of Patent: Nov. 24, 2026

(54) BAND, WATCH, AND BAND LENGTH ADJUSTMENT MECHANISM

(71) Applicant: SEIKO EPSON CORPORATION, Tokyo (JP)

(72) Inventors: Satoshi Yamauchi, Shiojiri (JP); Kenichiro Matsumoto, Fujimi (JP); Toru Takiuchi, Matsumoto (JP); Yuki Yamashita, Shiojiri (JP)

(73) Assignee: SEIKO EPSON CORPORATION (JP)

( * ) Notice: Subject to any disclaimer, the term of this patent is extended or adjusted under 35 U.S.C. 154(b) by 65 days.

(21) Appl. No.: 18/887,169

(22) Filed: Sep. 17, 2024

(65) Prior Publication Data

US 2025/0009083 A1 Jan. 9, 2025

Related U.S. Application Data

(63) Continuation of application No. 18/163,462, filed on Feb. 2, 2023, now Pat. No. 12,121,121.

(30) Foreign Application Priority Data

Feb. 3, 2022 (JP) ..... 2022-015484

(51) Int. Cl.
*A44C 5/24* (2006.01)

(52) U.S. Cl.
CPC ..... *A44C 5/246* (2013.01)

(58) Field of Classification Search
CPC ... A44C 5/246; A44C 5/0007; Y10T 24/2155; Y10T 24/4782
See application file for complete search history.

(56) References Cited

U.S. PATENT DOCUMENTS

| | | | | |
|---|---|---|---|---|
| 2,596,186 | A | 5/1952 | Volk | |
| 6,944,916 | B2 | 9/2005 | Kawagoe | |
| 7,289,310 | B1 | 10/2007 | Yuan | |
| 8,001,658 | B2 * | 8/2011 | Christian | A44C 5/246 24/71 J |
| 8,789,245 | B2 | 7/2014 | Leger | |
| 9,003,611 | B2 | 4/2015 | Catanese | |

(Continued)

FOREIGN PATENT DOCUMENTS

| | | | |
|---|---|---|---|
| CN | 105029841 | A | 11/2015 |
| JP | 2003-204813 | A | 7/2003 |
| JP | 2015-500050 | A | 1/2015 |

*Primary Examiner* — Jason W San
*Assistant Examiner* — Rowland Do
(74) *Attorney, Agent, or Firm* — Harness, Dickey & Pierce, P.L.C.

(57) ABSTRACT

A band includes a clasp, wherein the clasp includes a cover member and an adjustment portion, the adjustment portion includes a pair of rail portions that are arranged along inner sides of two side walls of the cover member in a longitudinal direction of the cover member and have a plurality of grooves for length adjustment, a pressing portion that is disposed at an inner bottom surface of the cover member and includes an elastic member, and an engagement pin that is inserted through the one end of a adjustment piece and is configured to be engaged with the grooves of the rail portions, and the pressing portion is configured to press the engagement pin against the rail portions in a state where the engagement pin is engaged with the pair of grooves.

7 Claims, 13 Drawing Sheets

(56) References Cited

U.S. PATENT DOCUMENTS

| | | | | |
|---|---|---|---|---|
| 9,149,093 | B2 | 10/2015 | Leger et al. | |
| 9,615,634 | B2 * | 4/2017 | Kaltenrieder | A44B 17/0017 |
| 10,722,006 | B2 | 7/2020 | Christian et al. | |
| 10,932,532 | B2 * | 3/2021 | Vuilleme | A44C 5/24 |
| 11,006,705 | B2 * | 5/2021 | Hatanaka | A44C 5/243 |
| 11,013,301 | B2 | 5/2021 | Yang et al. | |
| 11,388,961 | B2 | 7/2022 | Celant et al. | |
| 11,730,240 | B2 | 8/2023 | Yamashita | |
| 11,786,017 | B2 | 10/2023 | Granito | |
| 11,903,462 | B2 | 2/2024 | Granito | |
| 2005/0237864 | A1 * | 10/2005 | Albisetti | A44C 5/22<br>368/282 |
| 2005/0262668 | A1 * | 12/2005 | Ho | A44C 5/24<br>24/71 J |
| 2008/0083101 | A1 | 4/2008 | Christian et al. | |
| 2009/0049667 | A1 * | 2/2009 | Takahashi | A44C 5/246<br>24/71 J |
| 2014/0223705 | A1 | 8/2014 | Catanese | |
| 2014/0352119 | A1 | 12/2014 | Kaltenrieder et al. | |
| 2015/0181989 | A1 | 7/2015 | Catanese | |
| 2015/0366303 | A1 * | 12/2015 | Pier | A44C 5/246<br>24/71 J |

* cited by examiner

BAND, WATCH, AND BAND LENGTH ADJUSTMENT MECHANISM

This application is a continuation of U.S. application Ser. No. 18/163,462 filed Feb. 2, 2023, and claims priority from JP Application Serial Number 2022-015484, filed Feb. 3, 2022, the disclosures of which are hereby incorporated by reference herein in their entireties.

BACKGROUND

1. Technical Field

The present disclosure relates to a band, a watch having the band, and a band length adjustment mechanism.

2. Related Art

Bands with length adjustment mechanisms are known. For example, JP-A-2003-204813 proposes a band of which the total length can be adjusted in the same number of steps as the number of engagement grooves. According to JP-A-2003-204813, a guide groove and two engagement grooves that are continuous with the guide groove are symmetrically formed on both inner side surfaces of the cover member, such that the engagement grooves are engaged with both ends of a spring bar provided at the tip of an end piece of the band. The cover member and the band are separated from each other before engagement (see FIG. 2).

However, the band of JP-A-2003-204813 has room for improvement. For example, the length adjustment is in two steps due to the two engagement grooves and the adjustment range is small. Moreover, because the cover member and the band are separated before engagement, it is not easy for a general user to engage them.

That is, there has been a demand for a band that has a sufficient length adjustment range and is easy to use.

SUMMARY

A band according to an aspect of the present disclosure includes a first band attached to one end side of a watch body, a second band attached to another end side of the watch body, and a clasp coupling the first band and the second band, wherein the clasp includes a cover member and an adjustment portion, the adjustment portion includes a pair of rail portions that are arranged along inner sides of two side walls of the cover member in a longitudinal direction of the cover member and have a plurality of grooves for length adjustment, an adjustment piece coupled at one end thereof to an end portion of the first band, a pressing portion that is disposed at an inner bottom surface of the cover member and includes an elastic member, and an engagement pin that is inserted through another end of the adjustment piece and is configured to be engaged with the grooves of the rail portions, and the pressing portion is configured to press the engagement pin against the rail portions in a state where the engagement pin is engaged with the pair of grooves.

A watch according to an aspect of the present disclosure includes the band described above.

A band length adjustment mechanism according to an aspect of the present disclosure includes a first band attached to one end side of a watch body, a second band attached to another end side of the watch body, and a clasp coupling the first band and the second band, wherein the clasp includes a cover member and an adjustment portion, the adjustment portion includes a pair of rail portions that are arranged along inner sides of two side walls of the cover member in a longitudinal direction of the cover member and have a plurality of grooves for length adjustment, an adjustment piece coupled at one end thereof to an end portion of the first band, a pressing portion that is disposed at an inner bottom surface of the cover member and includes an elastic member, and an engagement pin that is inserted through another end of the adjustment piece and is configured to be engaged with the grooves of the rail portions, and the band length adjustment mechanism is structured such that when the adjustment piece is rotated about the engagement pin as an axis to be substantially perpendicular to the cover member, and the adjustment piece is pushed toward the cover member of the clasp, the elastic member is contracted and the engagement pin is disengaged from the grooves and the band length adjustment mechanism is configured such that, when the engagement pin is moved in the longitudinal direction of the cover member with the engagement pin disengaged from the grooves and then the adjustment piece is released at a desired band length, the adjustment piece moves away from the cover member of the clasp under a force of the elastic member to engage the engagement pin with the grooves corresponding to the desired band length.

DESCRIPTION OF EXEMPLARY EMBODIMENTS

First Embodiment

Overview of Watch and Band

Figure 1:
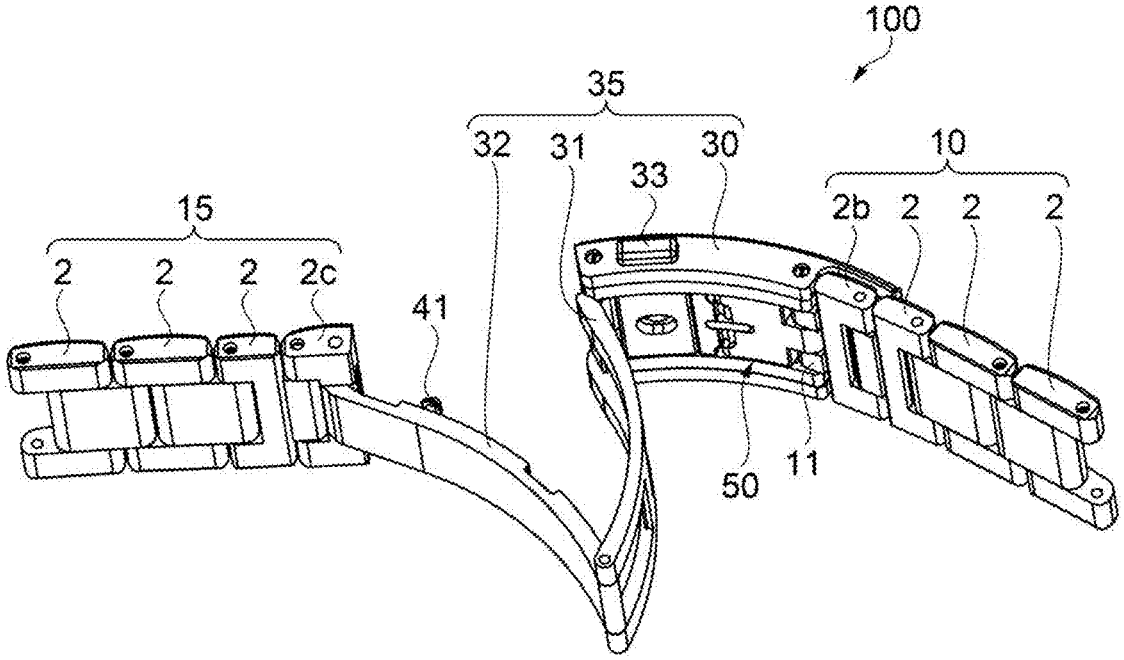
FIG. 1 is a perspective view showing an outline of a band according to a first embodiment.

FIG. 1 is a perspective view showing an outline of a band.

Figure 2:
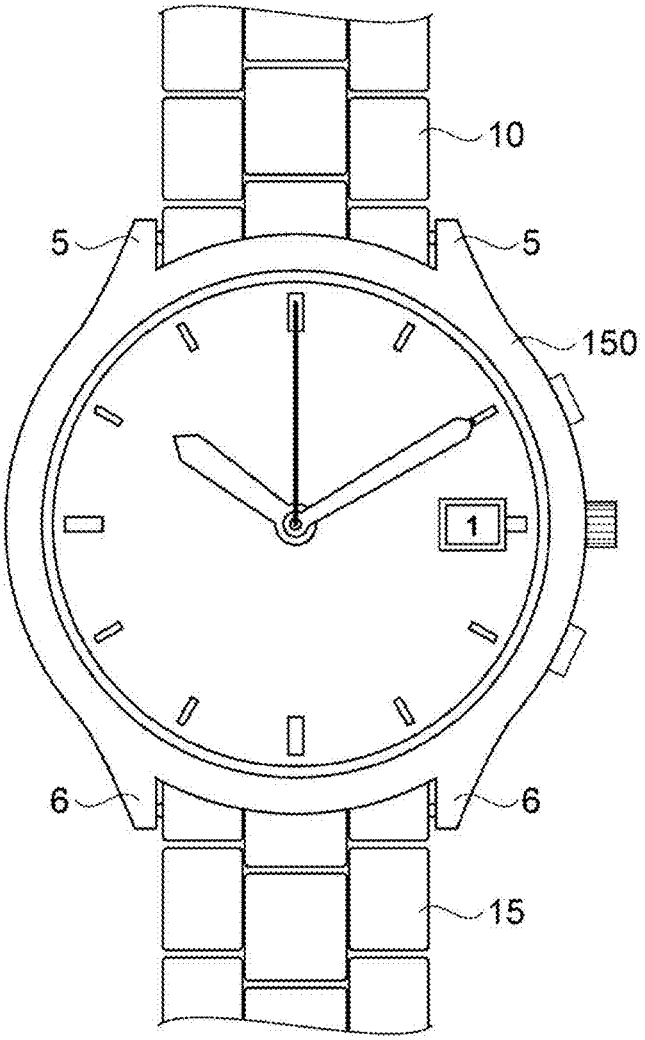
FIG. 2 is a front view of a watch.

FIG. 2 is a front view of a watch.

Embodiments of the present disclosure will be described below with reference to the drawings.

As shown in FIG. 1, a band 100 includes a first band 10, a second band 15, a clasp 35 coupling the first and second bands 10 and 15, and the like. The clasp 35 includes a cover member 30, an intermediate plate 31, a lower plate 32, and the like and is configured such that the clasp 35 is unfolded and extended as shown in FIG. 1 when buttons 33 provided on both side surfaces of the cover member 30 are pushed to release a latch pin 41.

As shown in FIG. 2, an end of the first band 10 is coupled to a lug 5 on the 12 o'clock side of the watch 150. Similarly, an end of the second band 15 is coupled to a lug 6 on the 6 o'clock side of the watch 150. In FIG. 2, the watch 150 is shown as a three-needle analog watch, but not limited thereto and may be any device worn on an arm such as, for example, a digital watch or a smart watch.

Reference will now be made back to FIG. 1.

The first band 10 includes a plurality of coupled pieces 2 and the like. An end piece 2*b* which is an end portion of the first band 10 is coupled to an adjustment portion 50 inside the cover member 30 via a coupling piece 11. The adjustment portion 50 will be described later.

The second band 15 includes a plurality of coupled pieces 2 and the like. An end piece 2*c* which is an end portion of the second band 15 is coupled to one end of the lower plate 32. The latch pin 41 is provided on the lower plate 32. The other end of the lower plate 32 is coupled to one end of the intermediate plate 31. The other end of the intermediate plate 31 is coupled to one end of the cover member 30.

The lower plate 32 is rotatably coupled to each of the end piece 2*c* of the second band 15 and the one end of the intermediate plate 31. The intermediate plate 31 is rotatably coupled to each of the one end of the cover member 30 and the other end of the lower plate 32.

Thus, the clasp 35 is configured to be switchable between a state in which the intermediate plate 31 and the lower plate 32 are folded in a Z shape and a state in which both are unfolded and extended. The cover member 30 is a buckle and has a curved shape as a whole in consideration of wearability on an arm. The cover member 30 has a substantially rectangular shape in plan view (see FIG. 3) and is arranged with its longitudinal direction parallel to an extending direction of the first band 10. The width of the cover member 30 in a lateral direction is substantially equal to that of the first band 10. The intermediate plate 31 and the lower plate 32 have the same curvature as the cover member 30 such that they follow a rear surface of the cover member 30 in the folded state. In a preferred example, the parts of the band 100 are made of stainless steel. The metal is not limited to stainless steel and any metal that is hard and has excellent texture such as, for example, titanium may be used.

Band Length Adjustment Mechanism

Figure 3:
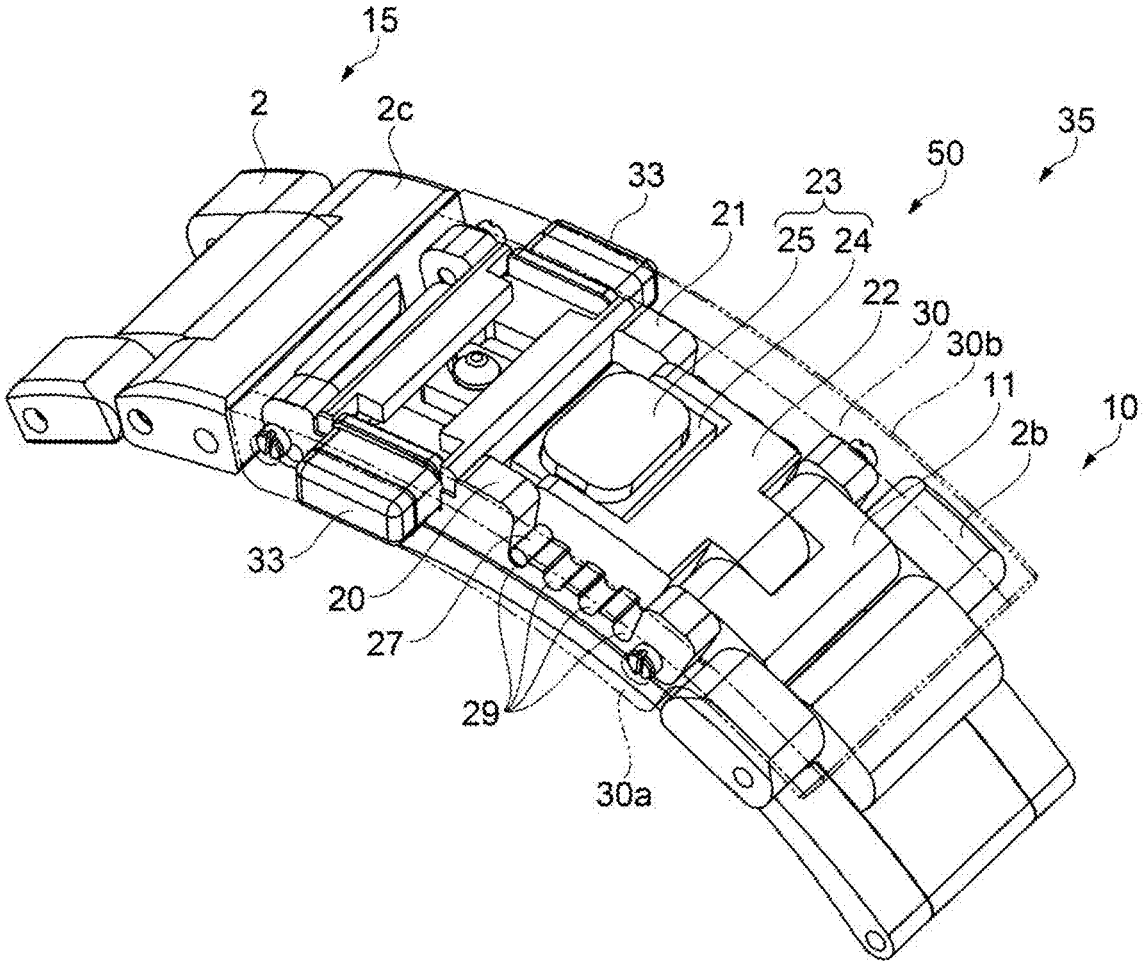
FIG. 3 is a see-through perspective view of an adjustment portion with a clasp folded.
Figure 4:
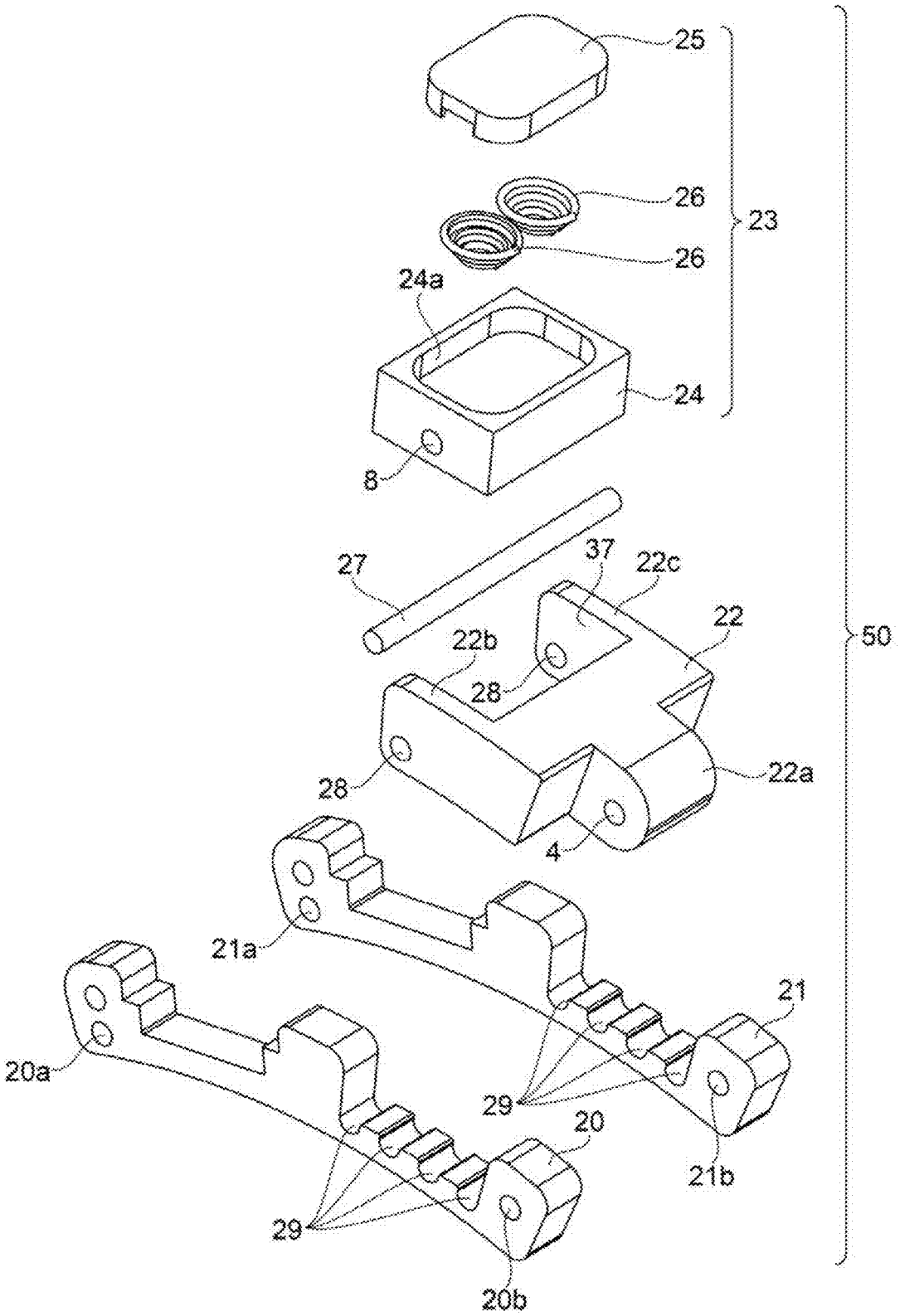
FIG. 4 is an exploded perspective view of the adjustment portion.

FIG. 3 is a see-through perspective view of the adjustment portion with the clasp folded. FIG. 4 is an exploded perspective view of the adjustment portion.

FIG. 3 is a see-through perspective view of the clasp 35 in the folded state, where the adjustment portion 50 inside the cover member 30 is seen through.

Here, the configuration of the adjustment portion 50 will be described with reference to FIGS. 3 and 4.

The adjustment portion 50 includes a pair of rail portions 20 and 21, an adjustment piece 22, a pressing portion 23, an engagement pin 27, and the like.

The rail portion 20 is a rail-shaped member arranged along a side wall 30*a* of the cover member 30 and is provided at one end thereof with a through hole 20*a* for coupling with the intermediate plate 31. The rail portion 20 is provided at the other end thereof with a fixing hole 20*b* for fixing the rail portion 20 to the side wall 30*a*. Grooves 29 for length adjustment are provided at four positions lateral to the fixing hole 20*b* at equal pitches. The rail portion 21 is a member paired with the rail portion 20, is arranged along a side wall 30*b* of the cover member 30, and has the same configuration as the rail portion 20. Specifically, the rail portion 21 is provided at one end thereof with a through hole 21*a* for coupling with the intermediate plate 31 and is provided at the other end thereof with a fixing hole 21*b* for fixing the rail portion 21 to the side wall 30*b*. The rail portion 21 also has grooves 29 for length adjustment at four positions.

The adjustment piece 22 has a protrusion 22*a* that protrudes toward the first band 10 and a protrusion 22*b* and a protrusion 22*c* which are two branches on the opposite side of the protrusion 22*a*. The protrusion 22*a* is provided with a through hole 4 for coupling with the coupling piece 11. The adjustment piece 22 is arranged between the rail portions 20 and 21. The coupling piece 11 that connects the adjustment piece 22 and the end piece 2*b* of the first band 10 has substantially the same size as the adjustment piece 22 and is also arranged between the rail portions 20 and 21.

A space between the protrusions 22*b* and 22*c* is a receiving portion 37 in which the pressing portion 23 is received. Each of the protrusions 22*b* and 22*c* is provided with a through hole 28 through which the engagement pin 27 is inserted.

The pressing portion 23 includes a pressing case 24, a lid 25, two springs 26, and the like.

The pressing case 24 is a rectangular parallelepiped body case for the pressing portion 23 and has a receiving portion 24*a* that receives the two springs 26 and a through hole 8 provided below the receiving portion 24*a*. The pressing case 24 is arranged with its long sides extending in the lateral direction of the cover member 30. The through hole 8 is a hole through which the engagement pin 27 is inserted and extends in the longitudinal direction of the pressing case 24. That is, the pressing case 24 is provided with the through hole 8 extending in the lateral direction of the cover member 30.

The lid 25 is a member that serves as a lid for the pressing case 24 and is formed in a size for engaging in the receiving portion 24*a*. The pressing portion 23 is constructed by setting the lid 25 while the two springs 26 are received side by side in the receiving portion 24*a* of the pressing case 24. The lid 25 is assembled with its top surface abutting an inner bottom surface of the cover member 30.

The springs 26 are elastic members, and in a preferred example, are conical springs. For example, a piano wire is used as a material for the springs 26. Any material which can obtain a necessary spring force may be used, and for example, a hard steel wire or a stainless steel wire may be used. Use of the conical springs can lower the solid height when compressed, compared to normal coil springs, such that the pressing portion 23 and the adjustment portion 50 can be compactly configured.

With the pressing portion 23 received in the receiving portion 37 of the adjustment piece 22, the engagement pin 27 is inserted through the through hole 28 of the protrusion 22*b*, the through hole 8 of the pressing case 24, and the through hole 28 of the protrusion 22*c* to integrate the pressing portion 23 and the adjustment piece 22.

In the folded state shown in FIG. 3, the engagement pin 27 is engaged with the grooves 29 at an innermost position which minimizes the length of the band among the four pairs of grooves 29 for length adjustment. At this time, the pressing portion 23 presses the engagement pin 27 toward the pair of grooves 29.

That is, the adjustment portion 50 includes the pair of rail portions 20 and 21, which are arranged along inner sides of the two side walls 30*a* and 30*b* of the cover member 30 in a longitudinal direction of the cover member 30 and have a plurality of grooves 29 for length adjustment, the adjustment piece 22 which is coupled at one end thereof to the end portion of the first band 10, the pressing portion 23 which is disposed on the inner bottom surface of the cover member 30 and includes the springs 26 as an elastic member, and the engagement pin 27 which is inserted through the other end of the adjustment piece 22 and is engageable with a pair of grooves 29 of the rail portions 20 and 21, wherein the pressing portion 23 presses the engagement pin 27 against the rail portions 20 and 21 in a state where the engagement pin 27 is engaged with the pair of grooves 29. The adjustment piece 22 has the receiving portion 37 that receives the pressing case 24 and the engagement pin 27 is inserted through the through holes 28 of the adjustment piece 22 and the through hole 8 of the pressing case 24 while the pressing case 24 is set in the receiving portion 37.

Figure 5:
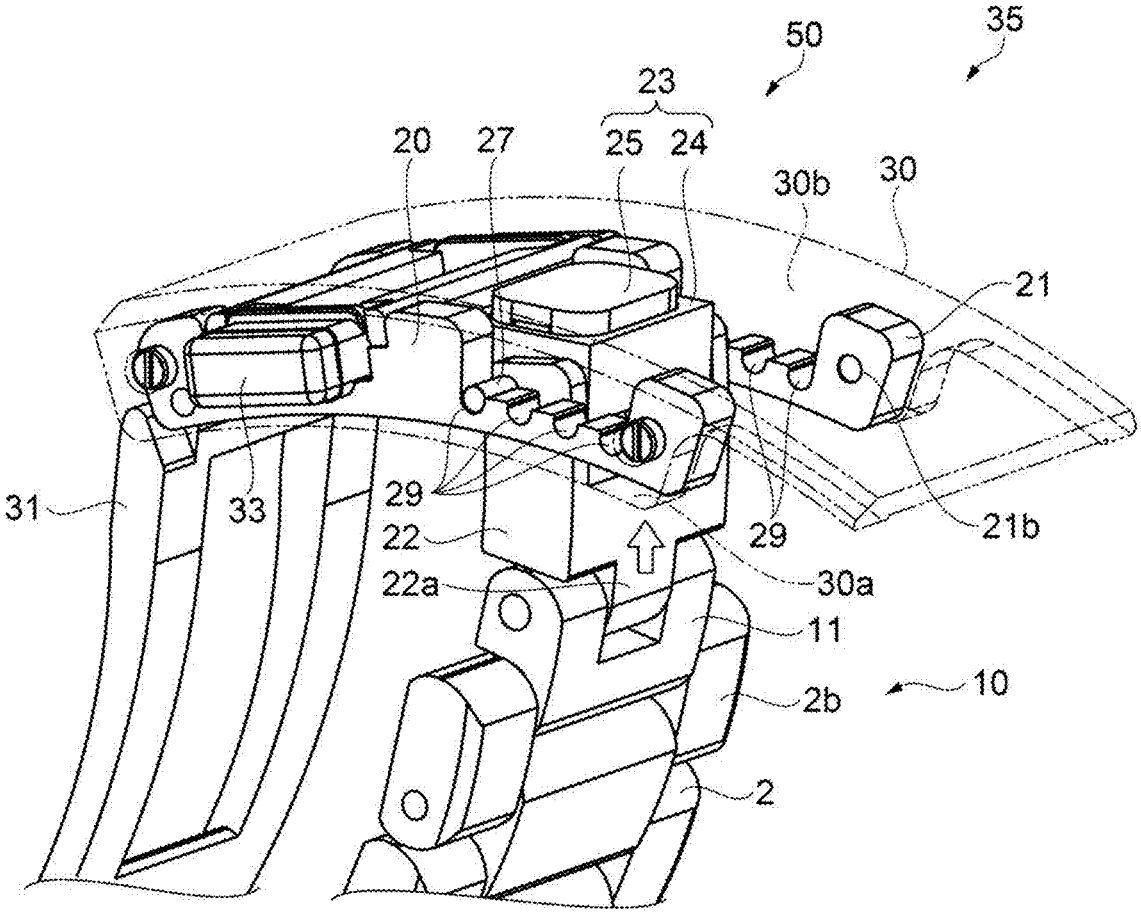
FIG. 5 is a see-through perspective view of the adjustment portion with the clasp unfolded.
Figure 6:
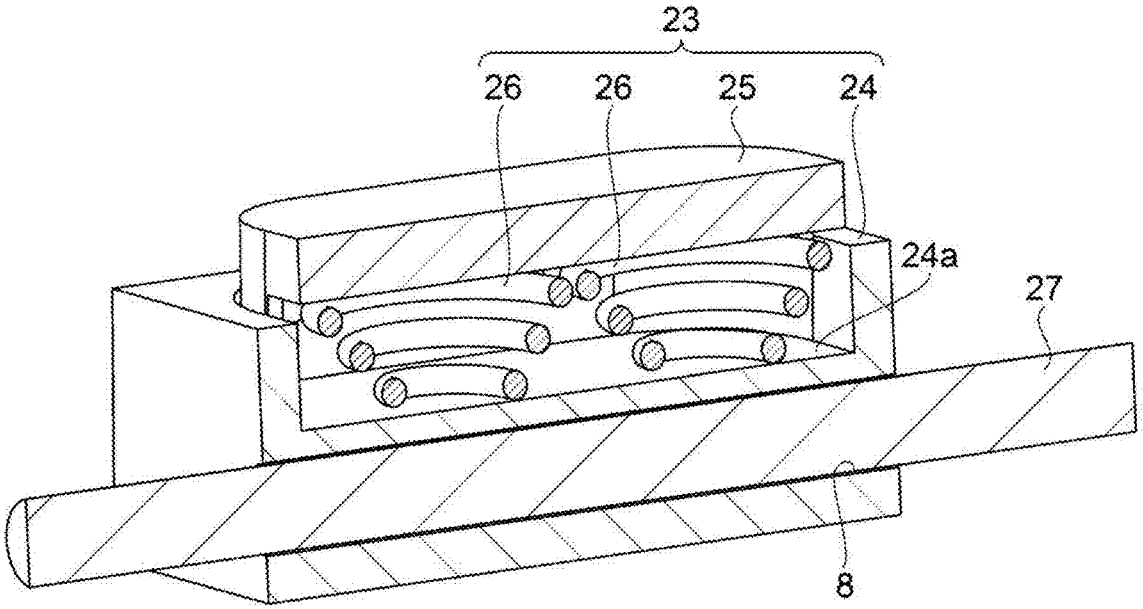
FIG. 6 is a see-through perspective view of a pressing portion.

FIG. 5 is a see-through perspective view of the adjustment portion with the clasp unfolded and corresponds to FIG. 3. FIG. 6 is a see-through perspective view of the pressing portion.

FIG. 5 is a see-through perspective view of the adjustment portion 50 with the clasp 35 unfolded, showing a state in which the adjustment piece 22 is erected relative to the cover member 30. The adjustment piece 22 is provided such that it can be erected about the engagement pin 27 as a rotation axis. While the clasp 35 is unfolded as shown in FIG. 5, the pressing portion 23 also presses the engagement pin 27 against the pair of grooves 29, such that the engagement pin 27 is secured in the pair of grooves 29 at the shortest position among those of the four steps of band length. FIG. 6 shows how the pressing portion 23 presses the engagement pin 27. The restoring force of the two springs 26 pushes the bottom surface of the receiving portion 24*a*, pressing the engagement pin 27 inserted through the through hole 28.

When adjusting the length of the band, the adjustment piece 22 is pushed toward the cover member 30 as indicated by a white arrow in FIG. 5 with the clasp 35 unfolded.

Band Length Adjustment Method

Figure 7:
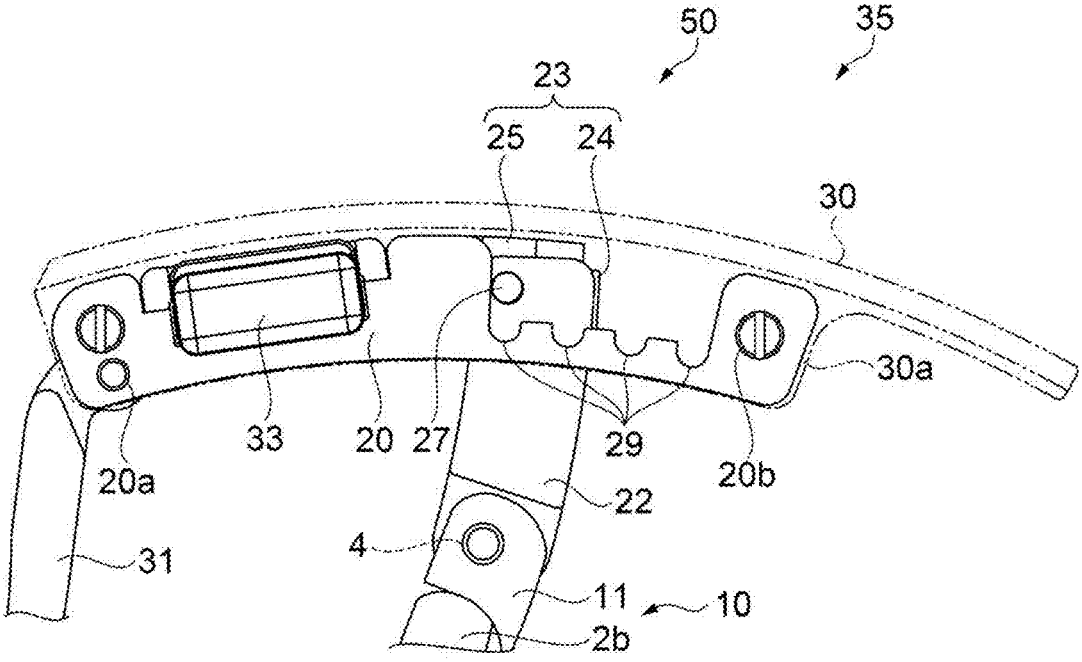
FIG. 7 is a side cross-sectional view of a main part showing a state in which length adjustment is performed.
Figure 8:
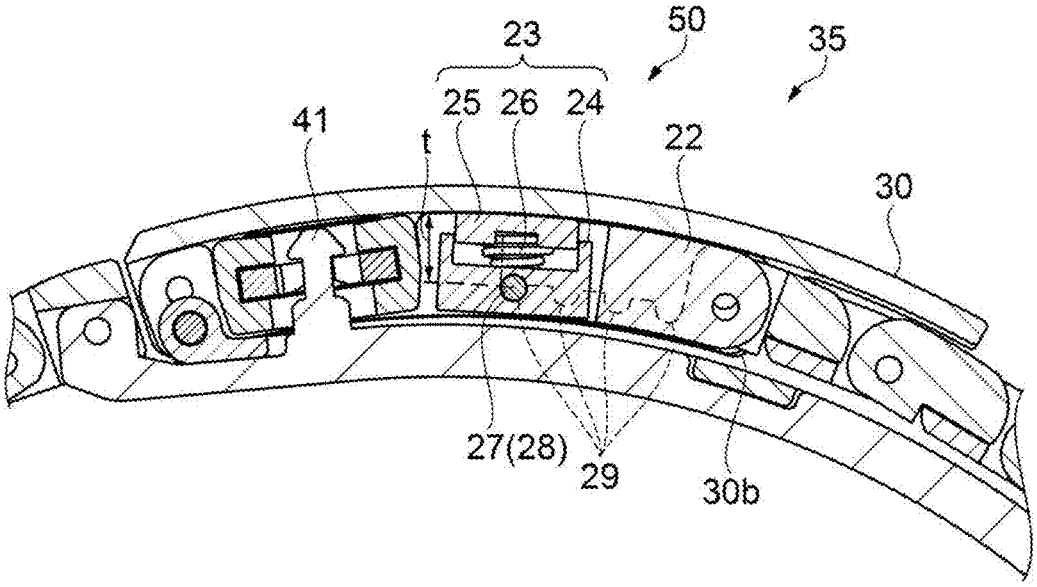
FIG. 8 is a side cross-sectional view of the main part when folded.

FIG. 7 is a side cross-sectional view of a main part showing a state in which length adjustment is performed. FIG. 8 is a side cross-sectional view of the main part when folded.

As shown in FIG. 7, when the adjustment piece 22 is pushed toward the cover member 30, the two springs 26 inside the pressing portion 23 are compressed and the engagement pin 27 is separated from the pair of grooves 29 and becomes slidable. Here, if the engagement pin 27 is moved to a pair of grooves 29 at the position of a desired length from among the four pairs of grooves 29 with the adjustment piece 22 pushed and then the adjustment piece 22 is released, the engagement pin 27 is engaged with the corresponding pair of grooves 29. FIG. 8 shows a state in which the clasp 35 is folded after length adjustment is done with the innermost pair of grooves 29 selected from the four pairs of grooves 29, from which it can be seen that the pressing portion 23 presses the engagement pin 27 against the selected pair of grooves 29 at the adjusted position.

As shown in FIG. 8, a thickness t from the center of the through holes 28 of the adjustment piece 22 to the top surface of the adjustment piece 22 is substantially equal to a distance from the center of the engagement pin 27 to the rear surface of the cover member 30 when the engagement pin 27 is engaged with the pair of grooves 29. That is, the top surface of the adjustment piece 22 which faces the cover member 30 abuts the cover member 30 while the adjustment piece 22 is received in the cover member 30. Thus, while the clasp 35 is folded, the top surface of the adjustment piece 22 serves as a stopper and thus can prevent the engagement pin 27 from being disengaged from the grooves 29.

Figure 9:
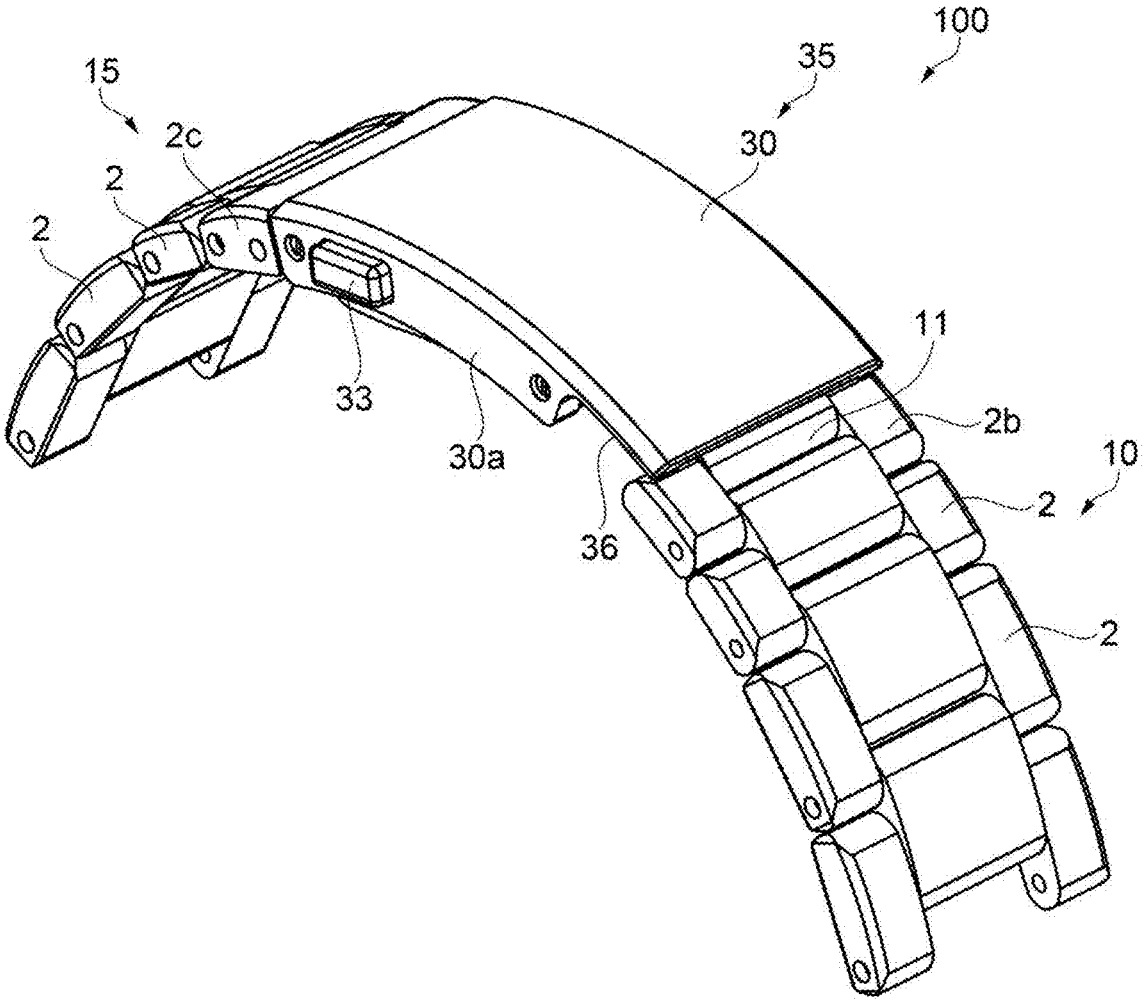
FIG. 9 is a perspective view of the band around the clasp.
Figure 10:
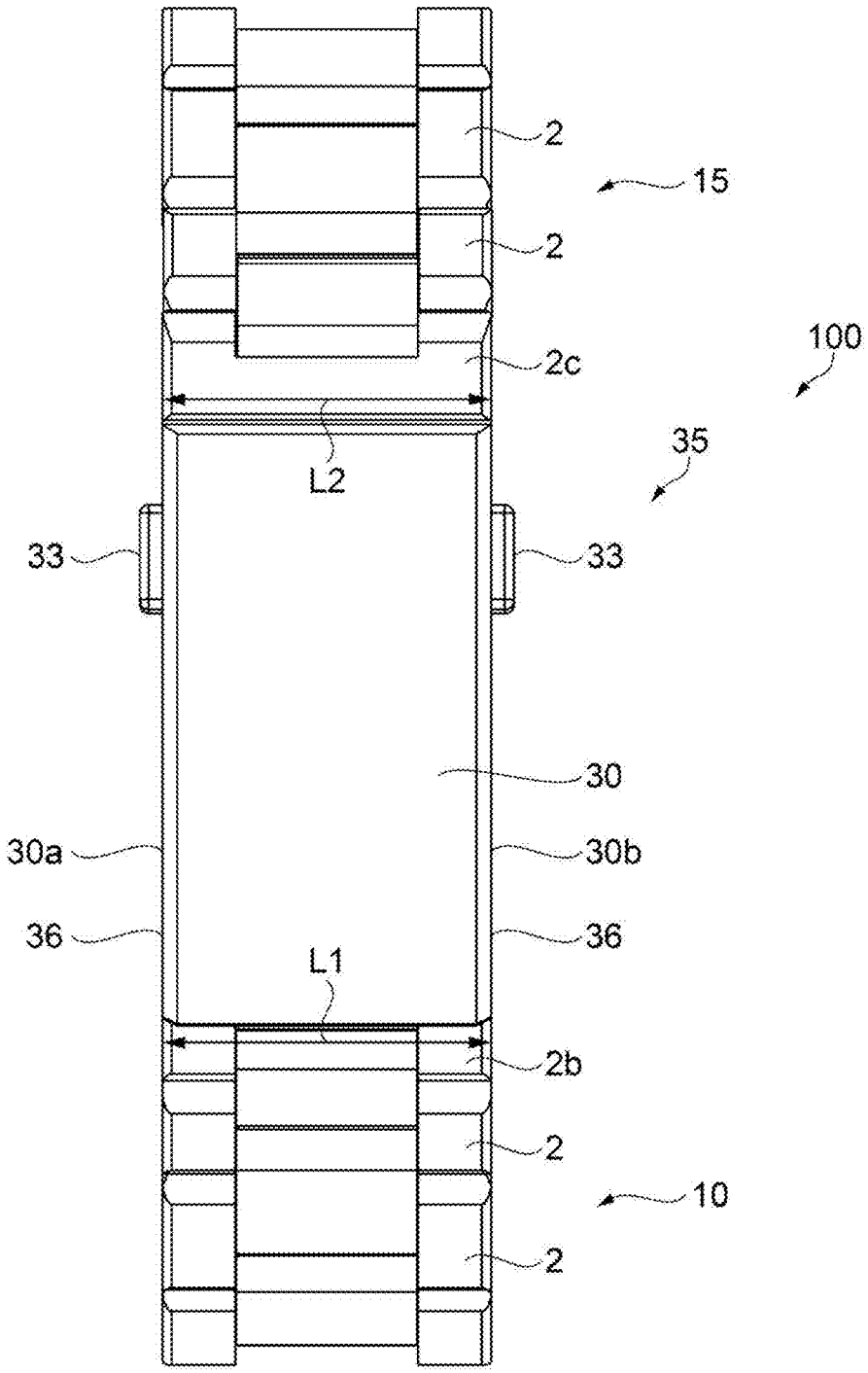
FIG. 10 is a plan view of the band around the clasp.

FIG. 9 is a perspective view of the band around the clasp. FIG. 10 is a plan view of the band around the clasp.

FIG. 9 is a perspective view of the band 100 when it is seen with the clasp 35 as the center. As shown in FIG. 9, the side wall 30*a* of the cover member 30 is provided with a notch 36. Specifically, the notch 36 is provided in the side wall 30*a* at a portion thereof closer to the first band 10. The side wall 30*b* is similarly provided with the notch 36. The length of the notch 36 is substantially equal to the length of adjustment using the four pairs of grooves 29, and in a preferred example, is set slightly longer than the width of the end piece 2*b* of the first band 10. The width of the end piece 2*b* is the length of the end piece 2*b* in the longitudinal direction of the cover member 30.

A length L1 of the end piece 2*b* is set substantially equal to the width of the cover member 30 in the lateral direction. A length L2 of the end piece 2*c* of the second band 15 is also set substantially equal to the width of the cover member 30 in the lateral direction.

FIGS. 9 and 10 show the appearance of the band 100 when the length adjustment of the band is set to the longest among the four steps. As shown in FIG. 10, when the band 100 is viewed in plan view, the side surfaces of the first band 10, the cover member 30, and the second band 15 are not stepped giving a continuous outline. Also, when the band length adjustment is set to the shortest as shown in FIG. 3, the end piece 2*b* of the first band 10 fits neatly into the notch 36, and in plan view, the side surfaces are not stepped giving a continuous appearance, similar to FIG. 10.

That is, the first band 10 includes a plurality of pieces 2 including the end piece 2*b*, the width of the cover member 30 in the lateral direction is substantially equal to the length L1 of the end piece 2*b*, and the notch 36 is provided in the two side walls 30*a* and 30*b* of the cover member 30 at a portion thereof closer to the first band 10.

That is, a band length adjustment mechanism of the clasp 35 including the adjustment portion 50 is structured such that when the adjustment piece 22 is rotated about the engagement pin 27 as an axis to be substantially perpendicular to the cover member 30, and the adjustment piece 22 is pushed toward the cover member 30, the springs 26 are contracted and the engagement pin 27 is disengaged from the grooves 29 and is configured such that, when the engagement pin 27 is moved in the longitudinal direction of the cover member 30 with the engagement pin 27 disengaged from the grooves 29 and then the adjustment piece 22 is released at a desired band length, the adjustment piece 22 moves away from the cover member 30 under the restoring force of the springs 26 to engage the engagement pin 27 with the grooves 29 corresponding to the desired band length.

A band 100 of the first embodiment can achieve the following advantages as described above.

The band 100 includes the first band 10 attached to one end side of the body of the watch 150, the second band 15 attached to the other end of the body of the watch 150, and the clasp 35 coupling the first and second bands 10 and 15, wherein the clasp 35 includes the cover member 30 and the adjustment portion 50, the adjustment portion 50 includes the pair of rail portions 20 and 21, which are arranged along inner sides of the two side walls 30*a* and 30*b* of the cover member 30 in a longitudinal direction of the cover member 30 and have a plurality of grooves 29 for length adjustment, the adjustment piece 22 that is coupled at one end thereof to the end portion of the first band 10, the pressing portion 23 that is disposed on the inner bottom surface of the cover member 30 and includes the springs 26 as an elastic member, and the engagement pin 27 that is inserted through the other end of the adjustment piece 22 and is engageable with a pair of grooves 29 of the rail portions 20 and 21, and the pressing portion 23 is configured to press the engagement pin 27 against the rail portions 20 and 21 in a state where the engagement pin 27 is engaged with the pair of grooves 29.

According to this configuration, when changing the length of the band 100, the adjustment piece 22 is erected and the pressing portion 23 is pushed using the adjustment piece 22 to disengage the engagement pin 27 from the pair of grooves 29 such that the engagement pin 27 can be moved to another pair of grooves 29. Further, the length adjustment range is of four steps, providing a great adjustment range. In addition, unlike the band of the related art in which the cover member and the band are separated and thus it is necessary to engage the cover member and the band when adjusting the length, long adjustment can be performed with a simple method of erecting and pushing the adjustment piece 22 while the cover member 30 and the first band 10 are coupled.

Accordingly, it is possible to provide the band 100 that has a sufficient length adjustment range and is easy to use. It is also possible to provide the watch 150 whose band length can be easily adjusted.

The pressing portion 23 includes the lid 25 abutting the bottom surface of the cover member 30, the pressing case 24 paired with the lid 25, and the springs 26 serving as an elastic member disposed between the lid 25 and the pressing case 24, the pressing case 24 is provided with the through hole 8 extending in the lateral direction of the cover member 30, the adjustment piece 22 has the receiving portion 37 that receives the pressing case 24, and the engagement pin 27 is inserted through the through holes 8 and 28 of the adjustment piece 22 and the pressing case 24 while the pressing case 24 is set in the receiving portion 37.

According to this, the pressing portion 23 has a simple configuration including the spring 26 between the pressing case 24 and the lid 25 and thus can be compactly configured. Because the pressing portion 23 is received in the receiving portion 37 of the adjustment piece 22, the adjustment portion 50 also has a compact configuration and can be configured in a size that fits inside the cover member 30.

Accordingly, the clasp 35 including the cover member 30 can also be compactly configured, such that it is possible to provide the band 100 that is easy to use.

The thickness of the adjustment piece 22 is substantially equal to the height of the side walls 30*a* and 30*b* of the cover member 30 and the top surface of the adjustment piece 22 which faces the cover member 30 abuts the cover member 30 while the adjustment piece 22 is received in the cover member 30.

According to this, while the clasp 35 is folded, the top surface of the adjustment piece 22 serves as a stopper and thus can prevent the engagement pin 27 from being disengaged from the pair of grooves 29. That is, it is possible to prevent unintentional length adjustment.

Accordingly, it is possible to provide the band 100 that is easy to use.

The adjustment piece 22 is coupled to the end piece 2*b* of the first band 10 via the coupling piece 11, the first band 10 includes a plurality of pieces 2 including the end piece 2*b*, the width of the cover member 30 in the lateral direction is substantially equal to the length L1 of the end piece 2*b*, and the notch 36 is provided in the two side walls 30*a* and 30*b* of the cover member 30 at a portion thereof closer to the first band 10.

According to this, when a coupling portion between the cover member 30 and the first band 10 is viewed from the outside, the widths of the cover member 30 and the first band 10 are substantially the same regardless of whether the length adjustment is short or long and thus the side surfaces thereof are not stepped giving a continuous appearance.

Accordingly, it is possible to provide the band 100 with excellent aesthetics.

The number of grooves 29 provided in each of the rail portions 20 and 21 is four.

According to this, length adjustment can be performed in four steps, unlike the related art with an adjustment range of only two steps.

Accordingly, it is possible to provide the band 100 with a sufficient length adjustment range.

The elastic member is a spring 26 that includes a conical spring.

Compared to cylindrical springs and leaf springs, conical springs have a shorter stroke for achieving the same load and are more durable. Conical springs are also small in volume when compressed. Thus, the pressing portion 23 can be compactly configured.

Accordingly, it is possible to provide the band 100 that is small and easy to use.

Second Embodiment

Different Configuration of Pressing Portion

Figure 11:
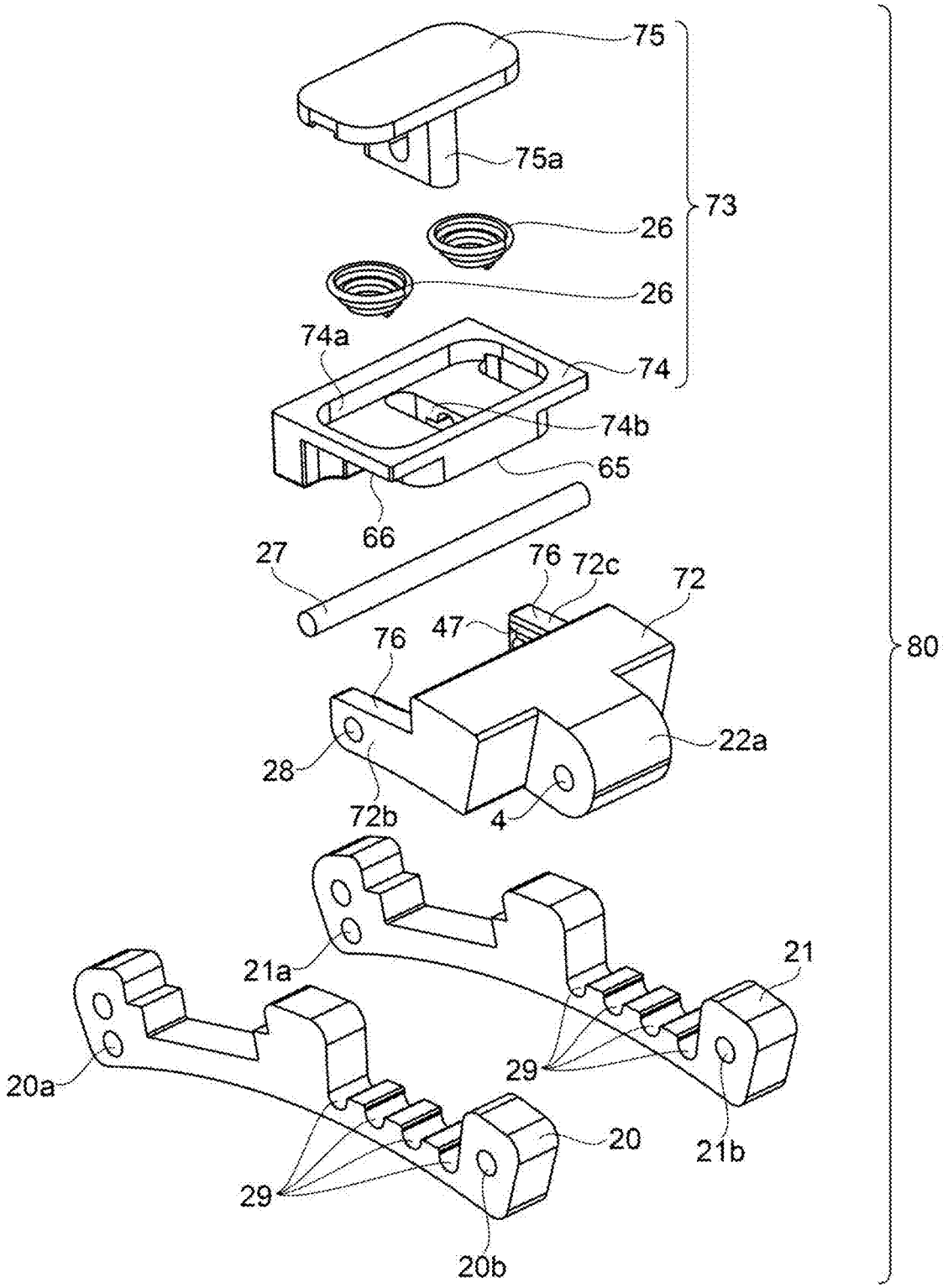
FIG. 11 is an exploded perspective view of a pressing portion according to a second embodiment.
Figure 12:
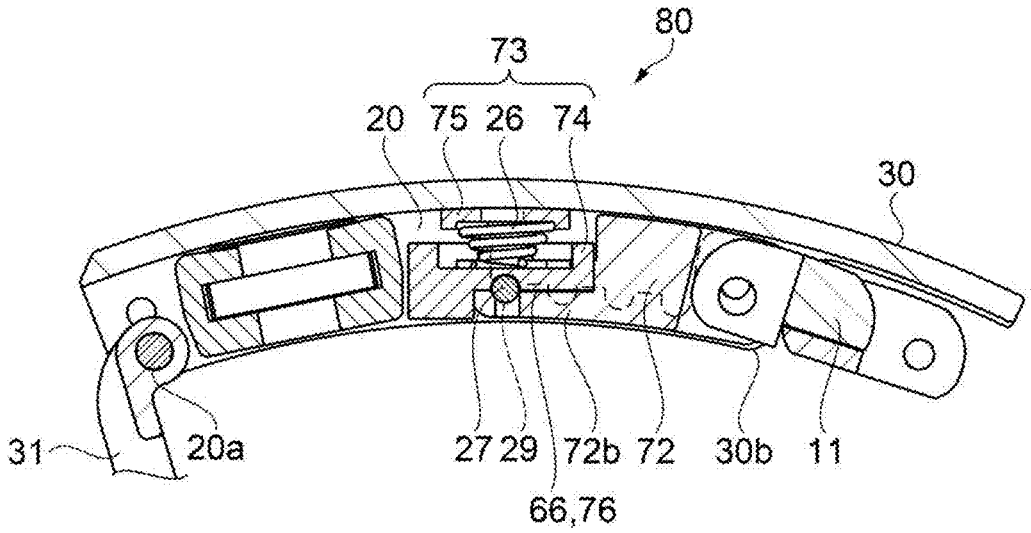
FIG. 12 is a side cross-sectional view of a main part showing a state of a pressing portion when unfolded.

FIG. 11 is an exploded perspective view of a pressing portion according to a second embodiment and corresponds to FIG. 4. FIG. 12 is a side cross-sectional view of a main part showing a state of the pressing portion when unfolded and corresponds to FIG. 5.

When the band 100 is unfolded, the adjustment piece 22 is erected as shown in FIG. 5 in the above embodiment, while an erection prevention mechanism may be provided. Specifically, in an adjustment portion 80 of the second embodiment, an adjustment piece 72 and a pressing portion 73 are provided with an erection prevention mechanism to prevent the adjustment piece 72 from being erected when the band 100 is unfolded.

As shown in FIG. 11, the adjustment portion 80 includes a pair of rail portions 20 and 21, an adjustment piece 72, a pressing portion 73, an engagement pin 27, and the like. The adjustment portion 80 of the second embodiment differs from that of the first embodiment in the configuration of the adjustment piece 72 and the pressing portion 73. Hereinafter, the same reference numerals will be given to the same components as those of the above embodiment and redundant descriptions will be omitted.

The adjustment piece 72 differs from the adjustment piece 22 of the first embodiment in a configuration thereof adjacent to the pressing portion 73. Specifically, the adjustment piece 72 includes a protrusion 72*b* and a protrusion 72*c* which are two branches on the opposite side of a protrusion 22*a*, while portions of the protrusions 72*b* and 72*c* abutting the pressing portion 73 are stepped down. The portions of the protrusions 72*b* and 72*c* that are stepped down are referred to as first surfaces 76. The protrusions 72*b* and 72*c* are provided with through holes 28.

Figure 13:
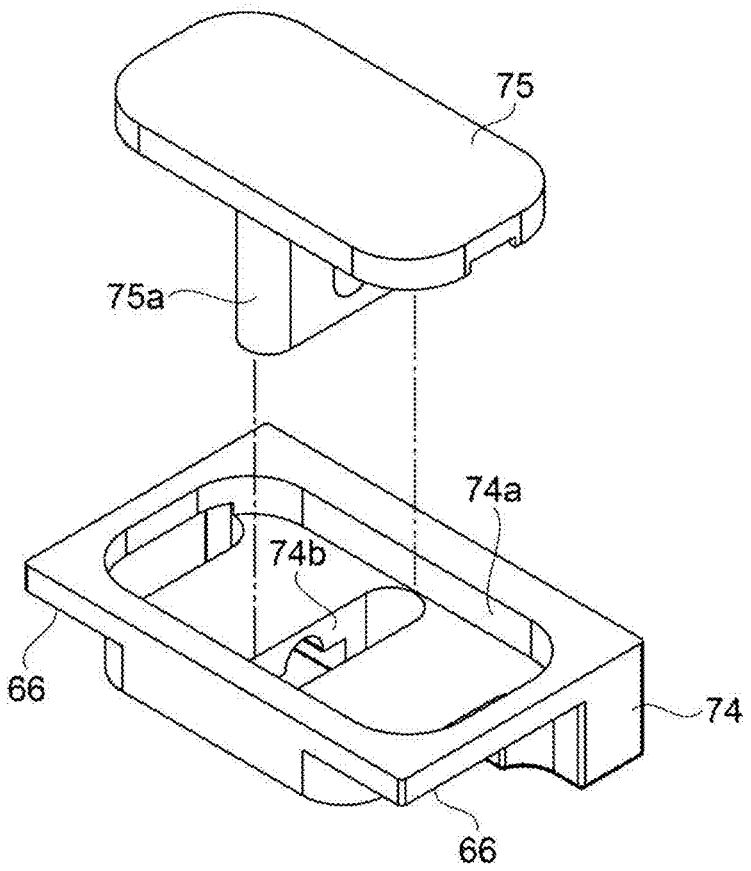
FIG. 13 is an exploded perspective view of a pressing case and a lid.
Figure 14:
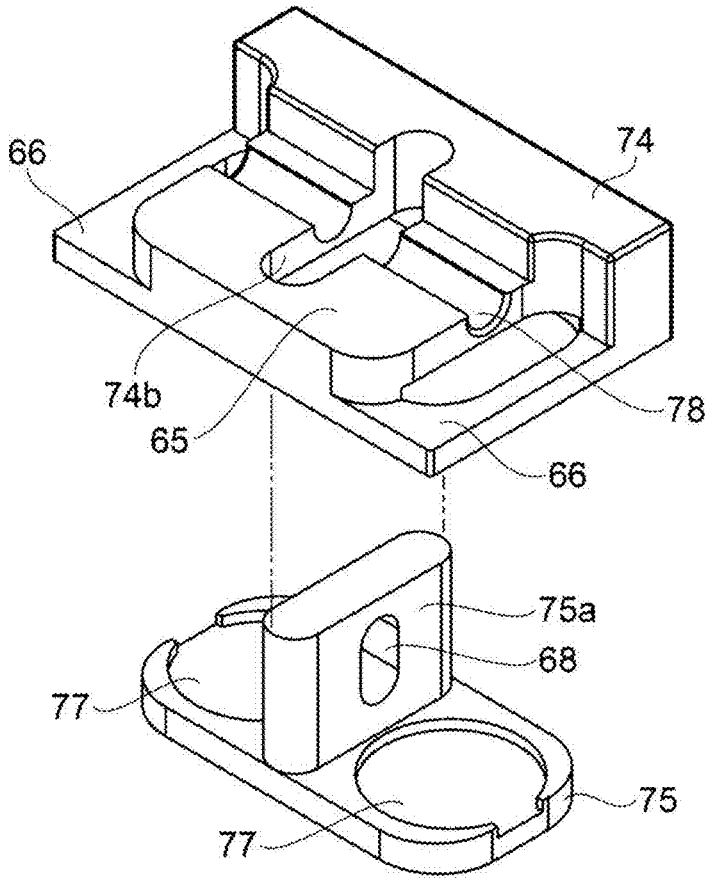
FIG. 14 is an exploded perspective view of the pressing case and the lid.

FIGS. 13 and 14 are exploded perspective views of a pressing case and a lid. In FIGS. 13 and 14, the springs 26 are not shown.

The pressing portion 73 includes the pressing case 74, the lid 75, the two springs 26, and the like.

As shown in FIG. 13, the pressing case 74 includes the two springs 26 and a receiving portion 74*a* that receives a part of the lid 75. An elongated hole 74*b* which is an oblong guide hole is formed in the receiving portion 74*a*. As shown in FIG. 14, the pressing case 74 has a bottom surface 65 that is stepped down from a base portion of the pressing case 74 on the rear side of the receiving portion 74*a*. The bottom surface 65 has grooves 78 for engaging with the engagement pins 27. An island-shaped protrusion having the bottom surface 65 is received in a receiving portion 47 between the two protrusions 72*b* and 72*c* of the adjustment piece 72 (see FIG. 11). The pressing case 74 has second surfaces 66 that are stepped down from the bottom surface 65 on both sides of the bottom surface 65. The two second surfaces 66 are portions corresponding to the two first surfaces 76 of the adjustment piece 72 (see FIG. 11).

As shown in FIG. 14, the lid 75 is provided with two placement portions 77 for placing the two springs 26 thereon and a shaft 75*a* between the two placement portions 77. The shaft 75*a* is a protrusion erected from a base portion of the lid 75 and has an oblong shape in plan view. An elongated hole 68 through which the engagement pin 27 is inserted is formed in the shaft 75*a*, passing through the side surfaces of the shaft 75*a*. The shaft 75*a* is inserted through the elongated hole 74*b* of the pressing case 74 and the engagement pin 27 is inserted through the elongated hole 68 of the shaft 75*a* with the shaft 75*a* inserted. The length of the elongated hole 68 is set to a length which allows the springs 26 to expand and contract with the engagement pin 27 inserted. The shaft 75*a* serves as a guide member for smoothing the movement of the pressing case 74 when the pressing case 74 moves up and down as the springs 26 expands and contracts.

With the two springs 26 set on the two placement portions 77 of the lid 75, the lid 75 and the pressing case 74 are combined to form the pressing portion 73 and then the pressing portion 73 is set in the receiving portion 47 of the adjustment piece 72 as shown in FIG. 11. With the pressing portion 73 received in the receiving portion 47 of the adjustment piece 72, the engagement pin 27 is inserted through the through hole 28 of the protrusion 72*b*, the elongated hole 68 of the shaft 75*a*, and the through hole 28 of the protrusion 72*c* to integrate the pressing portion 73 and the adjustment piece 72.

FIG. 12 is a side view of the main part of the band 100 including the adjustment portion 80 when unfolded.

As shown in FIG. 12, the adjustment piece 72 is received in the cover member 30 without being erected even when the band 100 is unfolded. This is because the springs 26 bias the lid 75 and the pressing case 74 in a direction to separate them, such that the second surfaces 66 of the pressing case 74 serving as a presser press the first surfaces 76 of the protrusions 72*b* and 72*c* of the adjustment piece 72 and thereby an end portion of the adjustment piece 72 adjacent to the coupling piece 11 is pressed against the cover member 30 by the principle of leverage. That is, the second surfaces 66 of the pressing case 74 serving as a presser, the first surfaces 76 of the adjustment piece 72, and related mechanisms function as an erection prevention mechanism.

That is, the lid 75 is provided with the shaft 75*a* having the elongated hole 68, the pressing case 74 has the second surfaces 66 serving as a presser that presses the adjustment piece 72 toward the side of the rail portions 20 and 21 and the elongated hole 74*b* through which the shaft 75*a* is inserted, the adjustment piece 72 has the receiving portion 47 that receives a part of the pressing case 74 and the through holes 28 extending in the lateral direction of the cover member 30, and the engagement pin 27 is inserted through the through holes 28 of the adjustment piece 72 and the elongated hole 68 of the shaft 75*a* in a case where a part of the pressing case 74 is set in the receiving portion 47.

Band Length Adjustment Method

Figure 15:
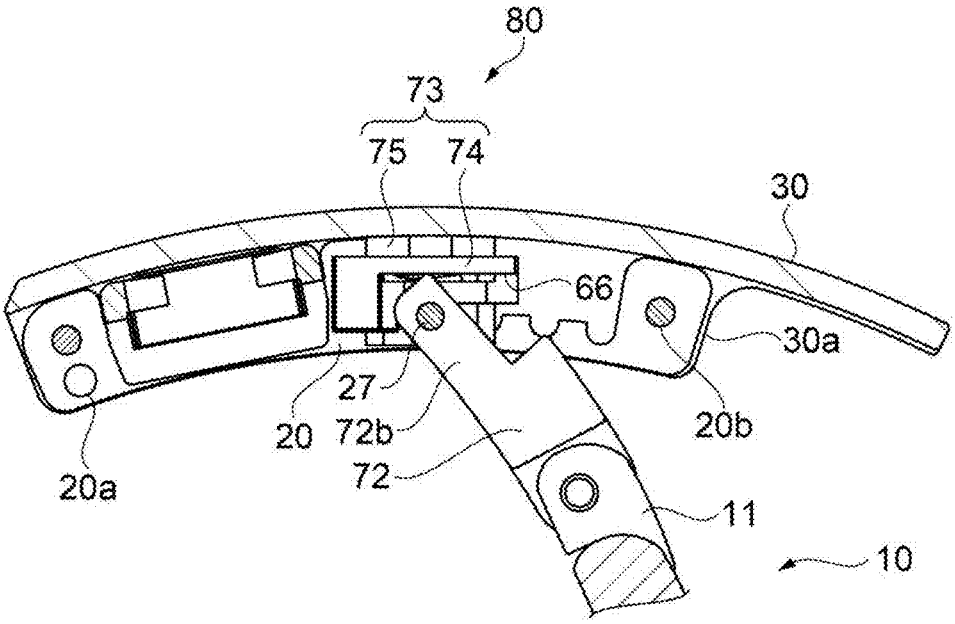
FIG. 15 is a side cross-sectional view of the main part showing a state in which length adjustment is performed.
Figure 16:
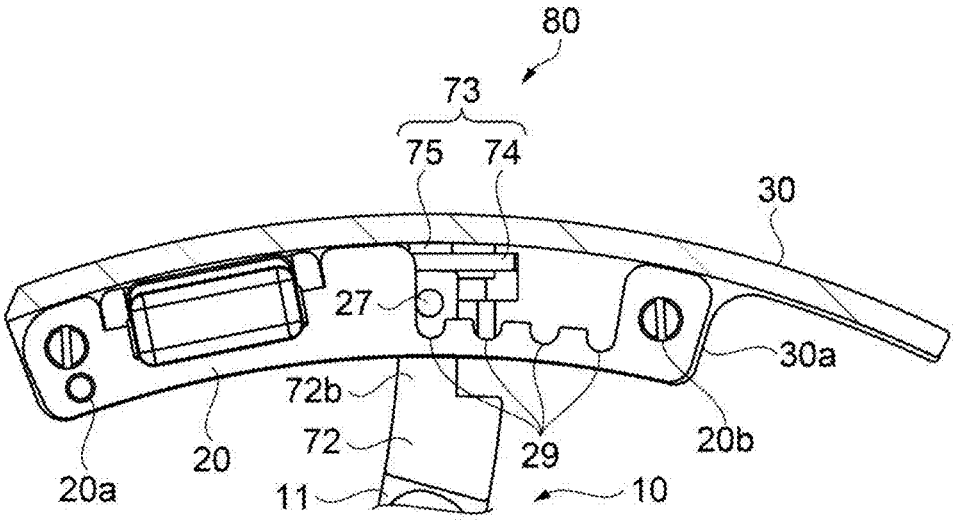
FIG. 16 is a side cross-sectional view of the main part showing a state in which length adjustment is performed.

FIGS. 15 and 16 are side cross-sectional views of the main part showing a state in which length adjustment is performed.

When adjusting the length of the band 100, the first band 10 is pulled below the cover member 30 in the unfolded state as shown in FIG. 15. When the pulling force exceeds the pressing force of the pressing portion 73, the tips of the protrusions 72*b* and 72*c* of the adjustment piece 72 push the second surfaces 66 of the pressing case 74 as if prying the second surfaces 66, such that the adjustment piece 72 is erected.

If the adjustment piece 72 is pushed toward the cover member 30 with the adjustment piece 72 erected, the two springs 26 inside the pressing portion 73 are compressed and the engagement pin 27 is separated from the pair of grooves 29 and becomes slidable as shown in FIG. 16. Here, if the engagement pin 27 is moved to a pair of grooves 29 at the position of a desired length from among those of the four pairs of grooves 29 with the adjustment piece 72 pushed and then the adjustment piece 72 is released, the engagement pin 27 is engaged with the corresponding pair of grooves 29.

The band 100 including the adjustment portion 80 of the second embodiment can achieve the following advantages as described above.

In the band 100, the pressing portion 73 includes the lid 75 abutting the bottom surface of the cover member 30, the pressing case 74 paired with the lid 75, and the springs 26 serving as an elastic member disposed between the lid 75 and the pressing case 74, the lid 75 is provided with the shaft 75*a* having the elongated hole 68, the pressing case 74 has the second surfaces 66 serving as a presser that presses the adjustment piece 72 toward the side of the rail portions 20 and 21 and the elongated hole 74*b* through which the shaft 75*a* is inserted, the adjustment piece 72 has the receiving portion 47 that receives a part of the pressing case 74 and the through holes 28 extending in the lateral direction of the cover member 30, and the engagement pin 27 is inserted through the through holes 28 of the adjustment piece 72 and the elongated hole 68 of the shaft 75*a* in a case where a part of the pressing case 74 is set in the receiving portion 47.

According to this, the pressing portion 73 has a simple and compact configuration in which two springs 26 are provided between the lid 75 and the pressing case 74. Because a part of the pressing case 74 is received in the receiving portion 47 of the adjustment piece 72, the adjustment portion 80 also has a compact configuration and can be configured in a size that fits inside the cover member 30.

Further, the pressing case 74 has the second surfaces 66 that function as a presser. The second surfaces 66 press the first surfaces 76 of the adjustment piece 72, such that an end portion of the adjustment piece 72 adjacent to the coupling piece 11 can be pressed against the cover member 30 by the principle of leverage. Thus, the second surfaces 66 serving as a presser function as a lock mechanism, such that it can prevent the adjustment piece 72 from hanging down when the clasp 35 is opened and closed. Also, when the clasp 35 is unfolded and worn on the arm, the band opening becomes large, making it easier to wear.

Accordingly, it is possible to provide a band 100 that is easy to use.

Further, the lid 75, the pressing case 74, and the adjustment piece 72 can be integrated by inserting the engagement pin 27, which facilitates assembly during manufacturing.

What is claimed is:

1. A band comprising:

a first band attached to one end side of a watch body;

a second band attached to another end side of the watch body; and a clasp coupling the first band and the second band, wherein the clasp includes a cover member and an adjustment portion, the adjustment portion includes:

a pair of rail portions that are arranged along inner sides of two side walls of the cover member in a longitudinal direction of the cover member and have a plurality of grooves for length adjustment;

an adjustment piece coupled at one end thereof to an end portion of the first band;

a pressing portion that is disposed at an inner bottom surface of the cover member and is configured with:

a lid having a bottom surface that abuts the bottom surface of the cover member, wherein the lid has a protrusion extending along a normal direction of the lid from a first opposite surface of the lid, and the protrusion has an elongated through hole along the normal direction therein;

a pressing case as a separate structure from the lid, wherein the pressing case has a recess facing the lid, a second opposite surface, and a guide through hole through which the protrusion is configured to be inserted; and an elastic member disposed between the first opposite surface of the lid and a bottom of the recess of the pressing case; and an engagement pin that is inserted through another end of the adjustment piece and is configured to be engaged with the grooves of the rail portions, the pressing portion is configured to press the engagement pin against the rail portions in a state where the engagement pin is engaged with the grooves, the adjustment piece has a receiving portion that receives the second opposite surface of the pressing case and an adjustment through hole, and the engagement pin is inserted through the adjustment through hole of the adjustment piece and the elongated through hole of the protrusion in a case where a part of the pressing case is set in the receiving portion.

2. The band according to claim 1, wherein a top surface of the adjustment piece that faces the cover member abuts the cover member in a state where the adjustment piece is received in the cover member.

3. The band according to claim 1, wherein the adjustment piece is coupled to an end piece of the first band via a coupling piece, the first band includes a plurality of pieces including the end piece, a width of the cover member in a lateral direction is substantially equal to a length of the end piece, and the lateral direction is perpendicular to each of the longitudinal direction and the normal direction, and a notch is provided in the two side walls of the cover member at a portion thereof closer to the first band.

4. The band according to claim 1, wherein the grooves are provided in each of the rail portions at four positions.

5. The band according to claim 1, wherein the elastic member is a conical spring.

6. A watch comprising the band according to claim 1.

7. A band comprising:

a first band attached to one end side of a watch body;

a second band attached to another end side of the watch body; and a clasp coupling the first band and the second band, wherein the clasp includes a cover member and an adjustment portion, the adjustment portion includes:

a pair of rail portions that are arranged along inner sides of two side walls of the cover member in a longitudinal direction of the cover member and have a plurality of grooves for length adjustment;

an adjustment piece coupled at one end thereof to an end portion of the first band;

a pressing portion that is disposed at an inner bottom surface of the cover member and includes an elastic member; and an engagement pin that is inserted through another end of the adjustment piece and is configured to be engaged with the grooves of the rail portions, the pressing portion is configured to press the engagement pin against the rail portions in a state where the engagement pin is engaged with the grooves, the pressing portion includes:

a lid abutting the bottom surface of the cover member;

a pressing case paired with the lid; and the elastic member disposed between the lid and the pressing case, wherein the pressing case has a pressing surface that faces and presses the adjustment piece toward the rail portions, the adjustment piece includes:

a pressed surface facing the pressing surface and being pressed by the pressing surface toward the rail portions, and a side of the one end of the adjustment piece is pressed toward the cover member by the pressing force from the pressing surface due to a principle of leverage.

* * * * *